United States Patent [19]

Russell

[11] 3,948,128

[45] Apr. 6, 1976

[54] FEED AND SEVERING APPARATUS

[75] Inventor: David B. Russell, Southboro, Mass.

[73] Assignee: Dennison Manufacturing Company, Framingham, Mass.

[22] Filed: Dec. 7, 1973

[21] Appl. No.: 422,842

[52] U.S. Cl. ..... 83/110; 83/322; 83/340; 83/444; 83/925 R; 227/76

[51] Int. Cl.[2] ..... B25C 1/00

[58] Field of Search ..... 83/110, 321, 322, 340, 83/341, 342, 444, 446, 672, 925 R; 227/64, 67, 73, 76, 93, 94, 95; 221/30; 241/82.4–82.7

[56] References Cited

UNITED STATES PATENTS

| | | | |
|---|---|---|---|
| 676,461 | 6/1901 | Geisel | 241/82.4 |
| 1,623,141 | 4/1927 | Walker | 241/82.5 |
| 2,034,604 | 3/1936 | Borsakovsky | 241/82.7 X |
| 2,717,639 | 9/1955 | James | 83/672 X |
| 2,815,076 | 12/1957 | Bukrey et al. | 83/446 |
| 3,243,092 | 3/1966 | Fraiser | 227/94 |
| 3,315,436 | 4/1967 | Baum et al. | 83/925 R |
| 3,626,797 | 12/1971 | Calvert et al. | 83/592 |
| 3,759,435 | 9/1973 | Bone | 227/95 |
| 3,820,580 | 6/1974 | Meserve et al. | 83/340 X |

*Primary Examiner*—J. M. Meister
*Attorney, Agent, or Firm*—Donald Brown

[57] ABSTRACT

A new and improved apparatus and method for feeding fastener attachments and stock having a plurality of spaced apart cross links coupled to side members, and severing the side members between adjacent cross members to form fastener attachment devices, i.e., fasteners.

22 Claims, 20 Drawing Figures

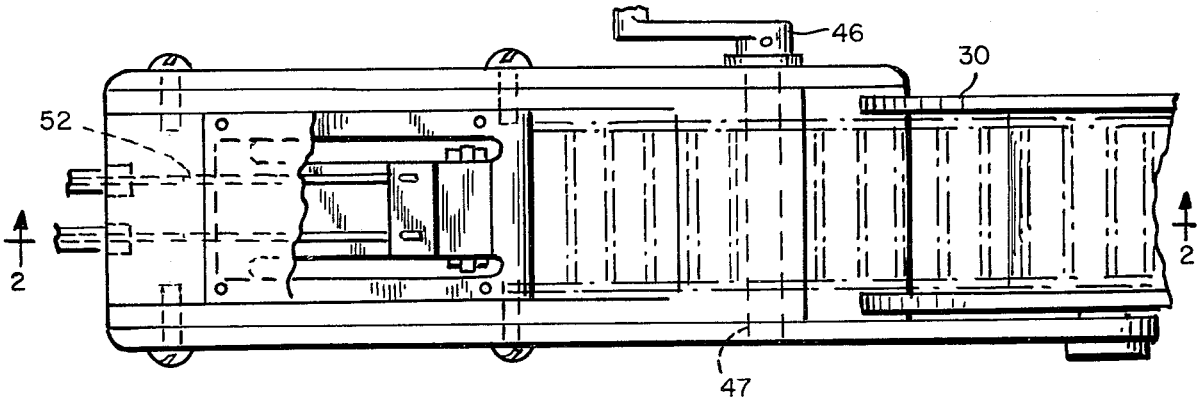
FIG. 1
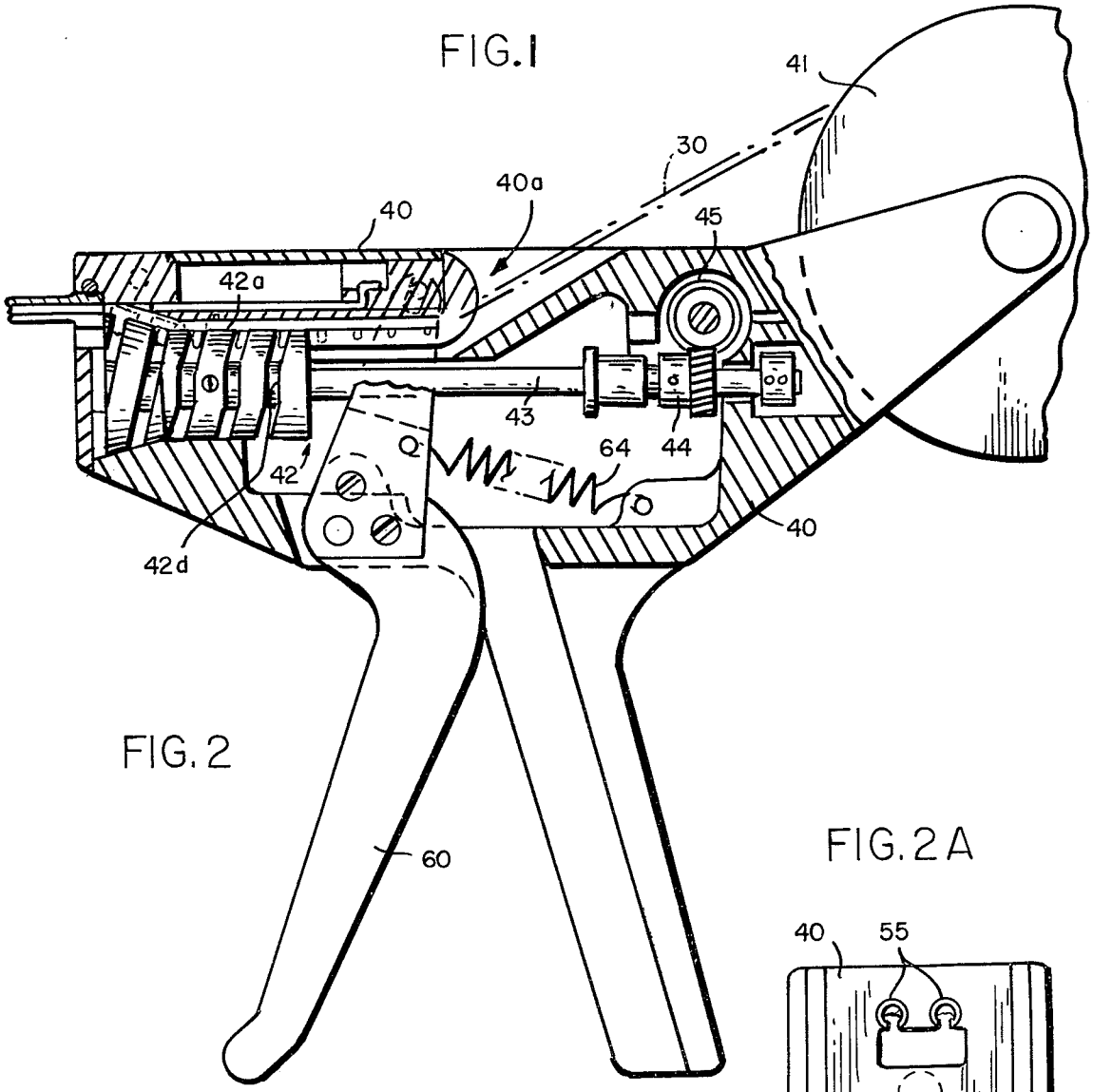
FIG. 2
FIG. 2A
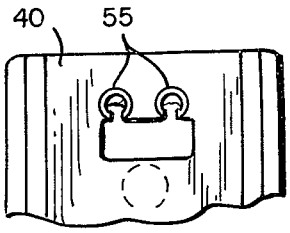

FEED AND SEVERING APPARATUS

BACKGROUND OF THE DISCLOSURE

This invention is directed to a new and improved fastener attachment dispensing apparatus or machine and more particularly to a fastener attachment dispensing apparatus embodying a complete departure in means for feeding fastener attachment stock and dividing or severing same prior to dispensing.

In recently filed U.S. patent applications, in the name of Arnold R. Bone, Ser. No. 347,679 filed Apr. 4, 1973, now U.S. Pat. No. 3,875,648 and Ser. No. 347,678 filed Apr. 4, 1973, both assigned to the assignee of this application, there is disclosed new and improved fastener attachment stock and apparatus for dispensing severed portions thereof. These applications and their disclosures are incorporated herein by reference.

In these prior art applications, plastic stock is shown comprising two elongated and continuous plastic side members having a plurality of plastic cross links or members coupled to and between each of said side members and preferably spaced equidistantly apart.

The stock may be formed of materials such as flexible plastics such as nylon, polyethylene, etc. An example of this invention is disclosed in FIGS. 17 and 18 of the present drawings. The stock may be formed by molding, stamping, etc., as shown in the aforementioned patent applications.

Since the stock forms no part of this invention it should be understood that it is being mentioned merely to set the stage for the invention.

These prior applications also disclosed feed die members relatively moveable to effect the severing of the aforementioned fastener stock along its side members to form fastener attachment devices prior to dispensing.

Dispensing of the fastener attachment devices is then accomplished through a hollow slotted needle(s) after one of the dies now carrying the device is moved to position the device at the rear of one or more needles.

The fastener attachment devices of this invention find utility in coupling buttons to fabric, coupling merchandising tags to merchandise, carding buttons and attaching of other materials e.g., tubing to a chassis (auto) or electrical wiring to a frame and in many other applications.

BRIEF SUMMARY OF THE INVENTION

As one aspect of this invention there are provided apparatus and method for advancing the side members of fastener attachment stock into side member guide means, means for severing the side members to form fastener attachment devices or fasteners while holding the same in the guide means, and means for advancing severed attachment devices and stock at the same time through said guide means to position the attachment devices for dispensing and the stock for the severing of other fastener attachment devices.

As another aspect of this invention there is provided feed screw means having grooves into which the cross members or links of the stock and fasteners are positioned and which, upon rotation, causes the cross members to advance.

A further aspect of this invention is a rotating knife which is used to cut or sever said side members.

Yet another aspect of this invention is the provision of a taper in the outside diameter of the feed screw to effect positioning of the fastener attachment devices relative to plungers for dispensing them through needles.

An additional aspect of this invention is the provision of a plurality of movable side member guides, at least one of which supports a dispensing needle. The guides are movable with respect to one another to alter their relative spacing.

A further aspect of this invention resides in the methods by which fastener attachment stock is fed by engagement of cross links with the sides of feed screw threads, and the severing of the side members of the stock.

BRIEF DESCRIPTION OF THE DRAWINGS

FIG. 1 is a top view of a portion of a dispensing apparatus (partially broken away) according to the invention;

FIG. 2 is a sectional view taken along line 2—2 in FIG. 1;

FIG. 2A is a partial front view of the apparatus of FIG. 1;

DETAILED DESCRIPTION OF THE DISCLOSURE

Figure 17:
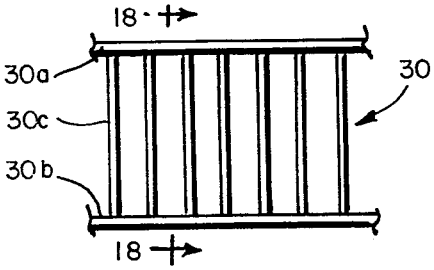
FIG. 17 illustrates a section of fastener attachment stock.
Figure 18:
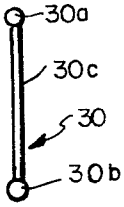
FIG. 18 illustrates an end view of the stock.

Reference should now briefly be had to FIGS. 17 and 18 which show a strip of fastener attachment stock 30 comprising side members **30*a* and 30*b* coupled together by cross links or members 30***c*. The stock 30 may be of plastic with the side members and cross links preferably being round in cross section and the side members 30*a* and 30*b* having a diameter greater than the diameter of the cross links 30*c*. The cross links 30*c* may be positioned equidistantly from each other as shown to obtain uniformly dimensioned fastener attachment devices after severing of the side members as will be described.

Figure 19:
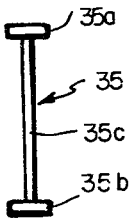
FIG. 19 illustrates in a side view a fastener attachment device formed from the stock.

FIG. 19 illustrates a fastener attachment device 35 after severing or cutting of the stock between adjacent cross links. The device 35 as shown comprises two side or end members 35*a* and 35*b* which are coupled together via a cross link or filament 35*c*.

At this time reference should be had to FIGS. 1–8 which illustrate an apparatus according to the invention.

At 40 (FIG. 2) there is disclosed the body or frame of the apparatus which supports at one end storage means such as a reel 41 for holding and providing long lengths of fastener attachment stock 30. The stock is rolled like film onto the reel 41 for dispensing.

The stock 30 is threaded into a feed screw shown at 42 through body opening 40*a*. The feed screw 42 is formed by a rod having a plurality of threads 42*a* (e.g., spiral) for advancing the stock 30.

The feed screw 42 is rotated by a shaft 43 which is, e.g., positioned and glued in a bore and is in turn coupled to a gear 44. The gear 44 is supported by a shaft as shown in the body of the apparatus and is rotated by another gear 45 driven by a handle 46 (FIG. 1) coupled to a shaft 47 upon which gear 45 is mounted.

Inasmuch as the exact means for rotating the screw feed can vary as will be apparent to those skilled in the art, the means disclosed herein is merely for explanation and is not to be construed as limiting.

Figure 4:
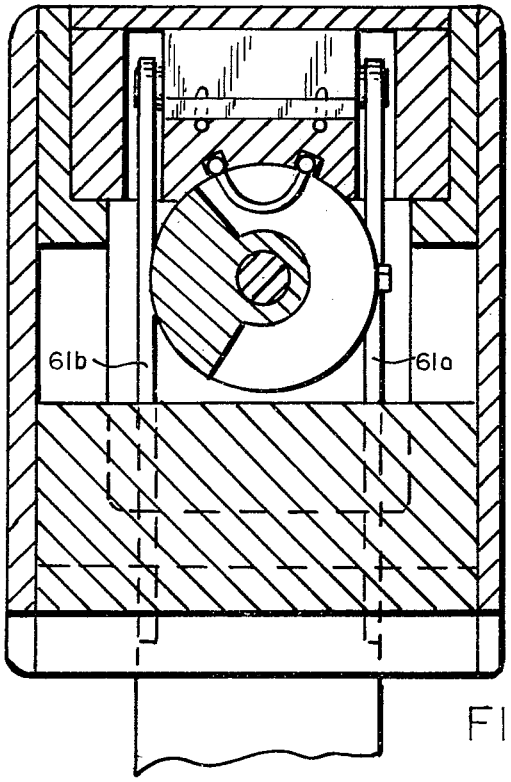
FIG. 4 is a sectional view taken along line 4—4 in FIG. 3.
Figure 5:
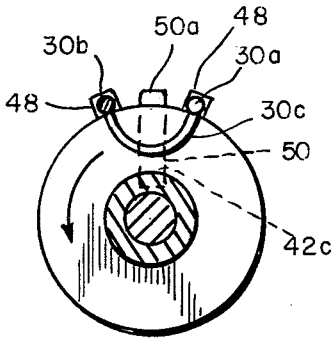
FIG. 5 is a diagrammatic sectional view with parts left out similar to FIG. 4 to show cuttong of the stock fastener attachment devices.
Figure 9:
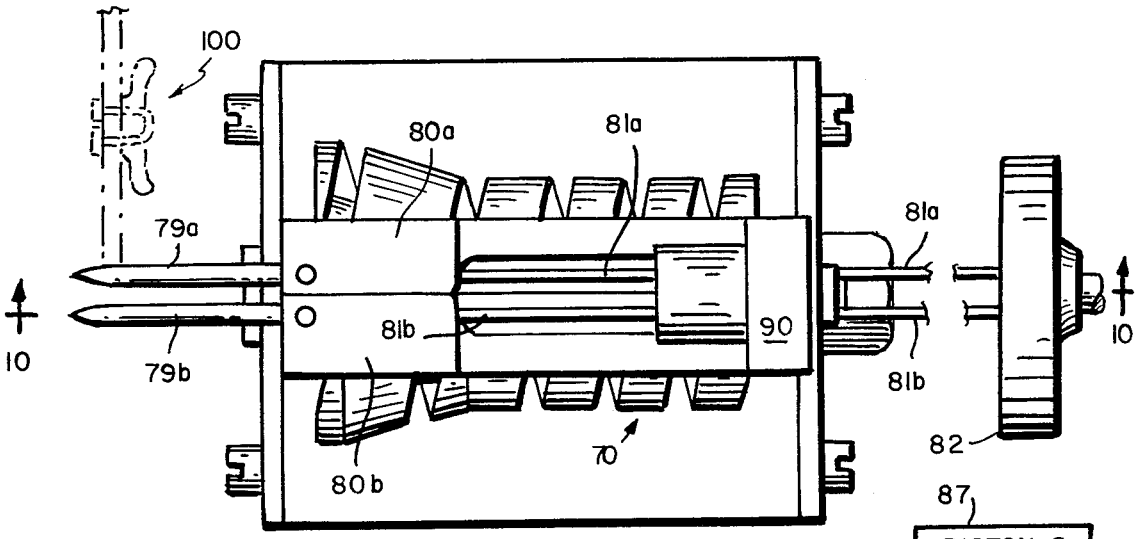
FIG. 9 illustrates in a plan view another form of the apparatus according to the invention.
Figure 10:
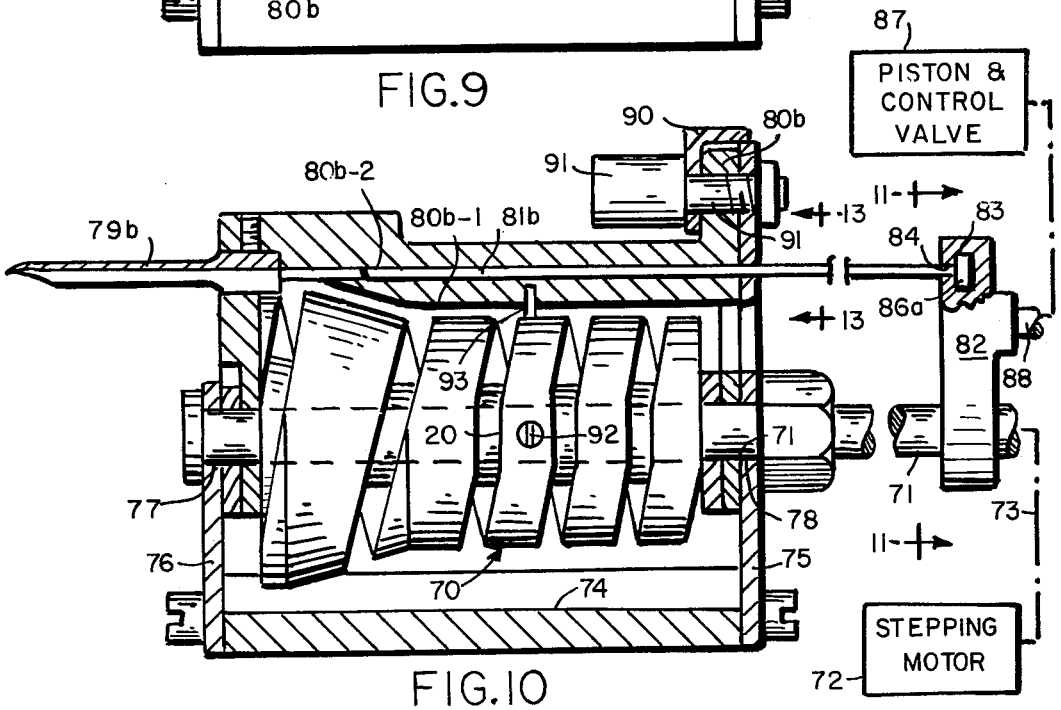
FIG. 10 is a sectional view taken along line 10—10 of FIG. 9.
Figure 11:
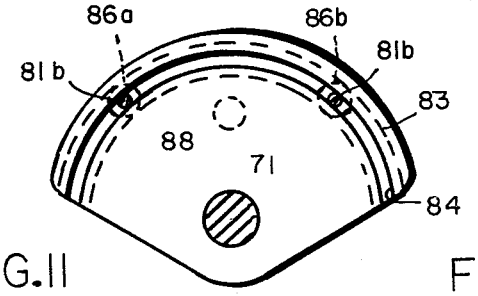
FIG. 11 is a sectional view taken along line 11—11 of FIG. 10.
Figure 12:
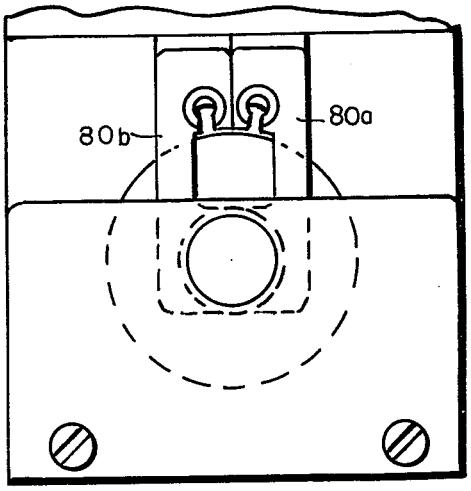
FIG. 12 is a front view taken to illustrate the adjustment of needle and guide spacing.
Figure 13:
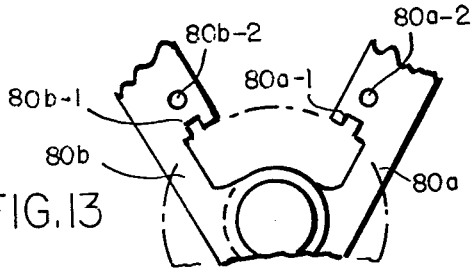
FIG. 13 is a sectional view taken along line 13—13 in FIG. 10 but with the needle and guides spaced apart.

The stock 30 is confined within guide channels 48 (FIGS. 7 and 8) which force the side members 30*a* and 30*b* together (relative to each other) to cause the cross links 30*c* to form partial loops as shown in FIGS. 4 and 5.

Figure 3:
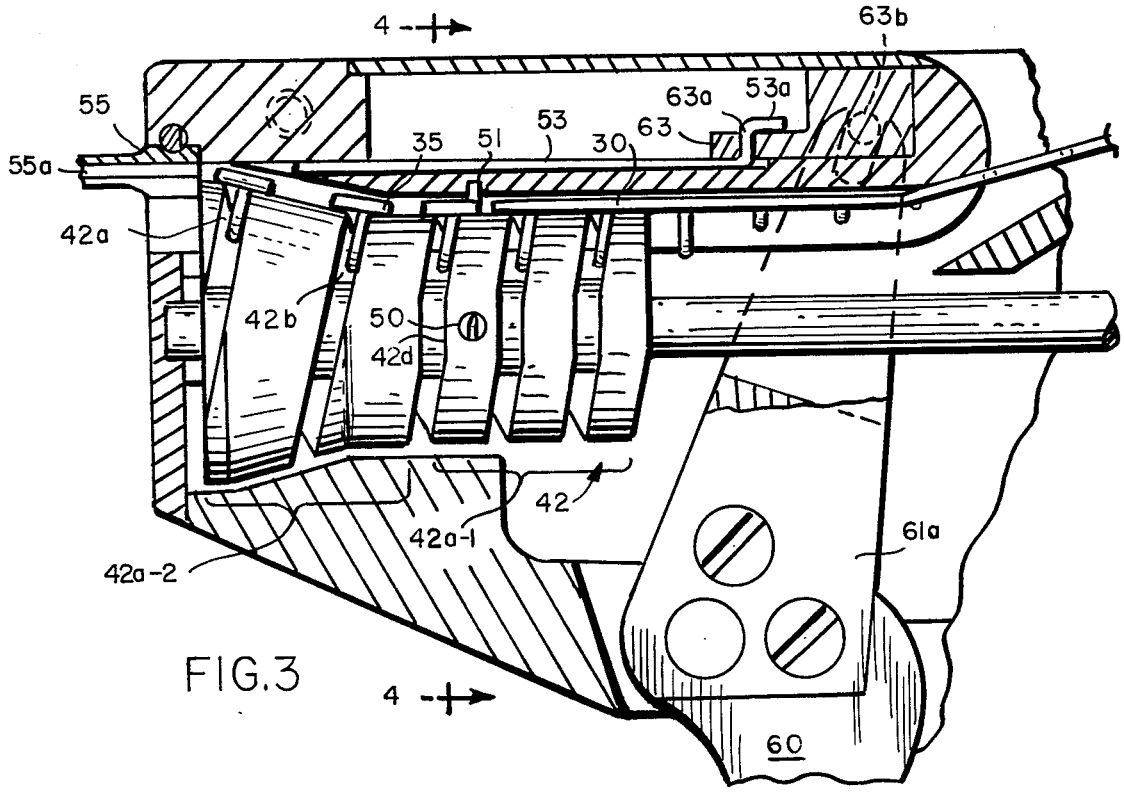
FIG. 3 is an enlarged view similar to FIG. 2 showing fastener stock being fed into and through the apparatus, as well as being severed to provide fastener attachment members.

The loops are captured or positioned between the screw threads 42*a* in the recesses or cavities 42*b* as shown in FIG. 3. Attachment devices are severed from the stock and both are advanced upon turning of the screw 42.

The channels 48 are in a top, removable body portion 40*b* (FIG. 2) which can be coupled to the body by screws or snap fasteners (not shown).

As may be seen in FIG. 3 the feed screw 42 has a first set or group of threads, whose tops lie on the surface of a first cylinder, for advancing the stock, and a second set or group of threads, whose tops lie on the surface of a cone and a second cylinder. The first group of threads is shown at 42*a*—1 and the second group of threads is shown at 42*a*—2. The first group of threads 42*a*—1 has a pitch equal to the spacing between cross links 30*c* (FIG. 17). Threads 42*a*—1 advance the stock to a point where it is severed into fastener attachment devices 35 (see FIGS. 3, 6 and 19).

Figure 7:
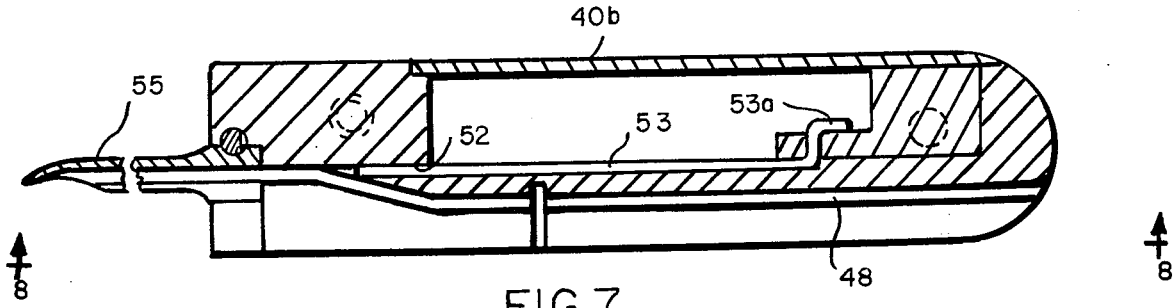
FIG. 7 is a partial sectional view taken along line 7—7 in FIG. 8.

The second group of threads 42*a*—2 has a larger pitch than the first group of threads and serves to separate or space the devices 35 further apart from each other after they are cut. A portion of the second group of threads also increases in diameter to raise the fastener attachment devices 35 for dispensing through the needle by the plunger 53 (FIGS. 3 and 7).

Severing or cutting is achieved in this apparatus by the screw feed supported knife 50 (FIGS. 3 and 5) which is positioned above the threads 42 and preferably held within a bore 42*c* (FIG. 5) located within one of the threads.

The knife 50 is adapted to rotate with the feed screw, and in rotating, the blade 50*a* (FIG. 5) sequentially enters the guide channels 48 via cross slit or channel 51 (FIG. 3) to first sever, cut or slice through side member 30*a* and then sever stock side member 30*b* to provide the fastener attachment devices 35.

FIG. 5 illustrates the knife blade 50*a* having been rotated as shown by the arrow to cut through the stock side member 30*a* and being rotated to cut through the stock side member 30*b*. In order to preferably cut through the stock side members 30*a* and 30*b* while the stock is substantially stationary a dwell is provided in the threads at 42*d* (see FIG. 3).

Figure 8:
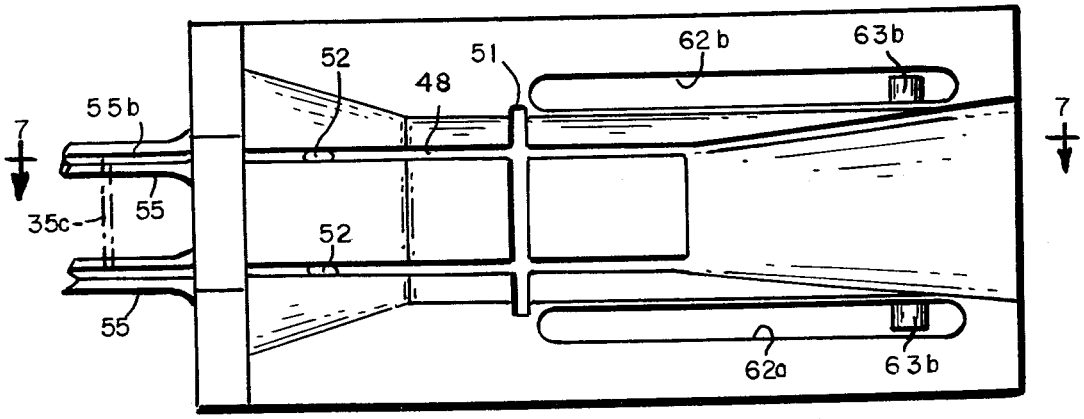
FIG. 8 is a bottom view taken along line 8—8 in FIG. 7.

In the body top portion 40*b* of FIGS. 7 and 8 (which includes channels 48 and 51) and is normally removed to thread stock into the feed screw, there are provided channels or guide means 52 in which plungers 53 are movable.

Figure 6:
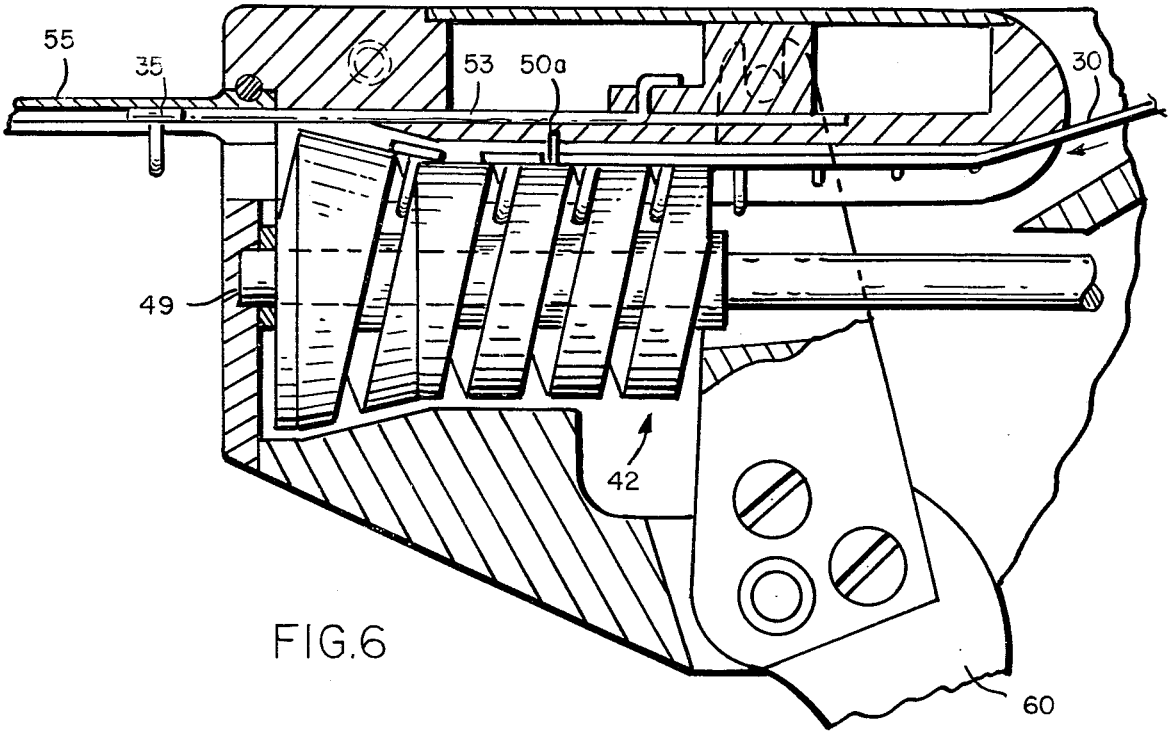
FIG. 6 is a sectional view similar to FIG. 3 illustrating the fastener attachment devices being dispensed through the needle of the apparatus.

The plungers 53 are positioned for reciprocating movement and enter the channels 48 at the rear of the point where the screw thread group 42*a*—2 raises and advances a fastener attachment device 35 into the bores 55*a* of two needles 55 (see FIGS. 3 and 6).

When a portion of the fastener attachment device 35 (namely ends 35*a* and 35*b*) enter the respective needle bores 55*a* of needles 55, the rotation of the screw 42 is stopped and at this point the plungers 53 are advanced as shown in FIG. 6 into the forward part of channel 48 and into the needle bores 55*a*.

During the passage through the needle bores 55*a*, the loops 35*c* of the devices extend between the two needles 55 (see dotted line in FIG. 8), through needle slots 55*b*.

In order to move the plungers 53, there is provided a pivotally mounted squeeze handle 60 (FIG. 3) supporting slide pushers 61*a* and 61*b* (not shown) which pass through slots 62*a* and 62*b* (FIG. 8).

Within the body portion 40*b* (FIG. 3) there is provided a slide 63 which supports in bores 63*a* the L shaped ends 53*a* of the plungers 53. The slide 63 carries pins 63*b* which are positioned in U shaped cutouts at the top of members 61*a* and 61*b*.

A spring 64 (FIG. 2) is provided to retain the handles apart and keep the slide 63 retracted.

Reference should now be had to FIGS. 9–13 which illustrate an alternate embodiment of the disclosure. In this embodiment the feed screw is shown at 70 and is supported for rotation on a shaft 71. The shaft 71 is incrementally rotated by hand or by a motor 72 such as a stepping motor through a gear train 73. The shaft is supported by base members 74, 75 and 76 for rotation in bearings 77 and 78. In this embodiment needles 79*a* and 79*b* are supported by adjustable stock guide and plunger guide members 80*a* and 80*b*.

The members 80*a* and 80*b* include stock guides or channels 80*a*—1 and 80*b*—1 (FIG. 13) and plunger guides 80*a*—2 and 80*b*—2 of the same construction as in FIGS. 1—8. Plungers 81*a* and 81*b* are in the plunger guides 80*a*—2 and 80*b*—2 and are reciprocated by hand via plate 82 (FIG. 10) movable on shaft 71.

The plate 82 has guide channels 83 and 84 in which the end plunger portions 86*a* and 86*b* (FIG. 11) are movable. Alternatively, a fluid or cam operated piston and a control valve 87 may be provided for reciprocating the plate 82 via shaft 88 coupled thereto.

In this embodiment the slotted needles 79*a* and 79*b* are adjustable relative to each other by the adjustment of clamping member 90 via set screw and nut 91 which fixes the rear top portions of the members 80*a* and 80*b*. A knife is shown at 92 which upon rotation of feed screw extends through cross slot 93 and severs the side members of the stock.

With this embodiment the position of the needles may for example be adjusted for button fastener operations depending upon the position of the holes in the buttons. At 100 in FIG. 9 there is shown a button coupled to fabric using the needles 79*a* and 79*b*.

Figure 14:
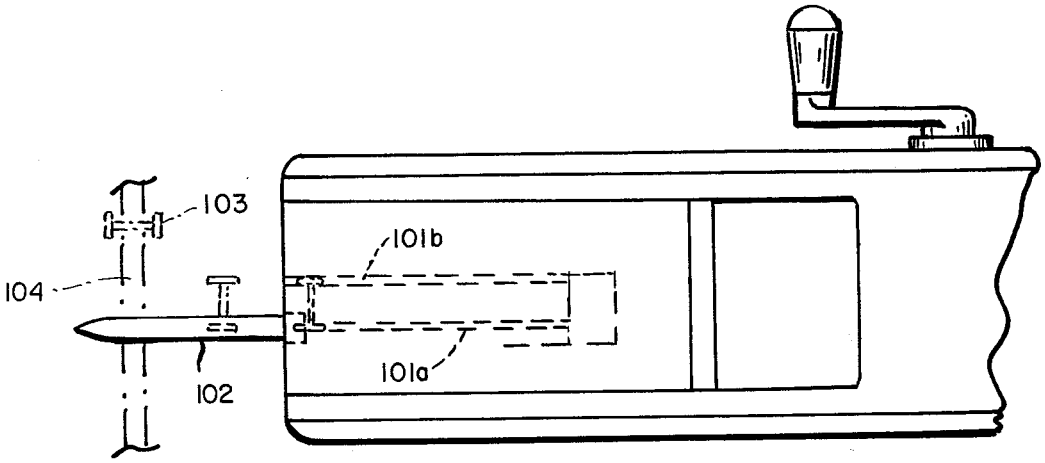
FIG. 14 is a top view of the apparatus of FIGS. 1—8 illustrating a modification wherein one needle is used to dispense fastener attachment members.

In FIG. 14 there is shown the machine of FIGS. 1–8 modified so that only one needle is used. In this construction the dispensing channels are at 101*a* and 101*b*, and only one needle is used. As may be seen the fastener attachment devices travel through the needle as shown with only one end of the fastener attachment device within the slot of the needle 102. At 103 there is shown a fastener attachment device extending through fabric 104 after being dispensed.

Figure 15:
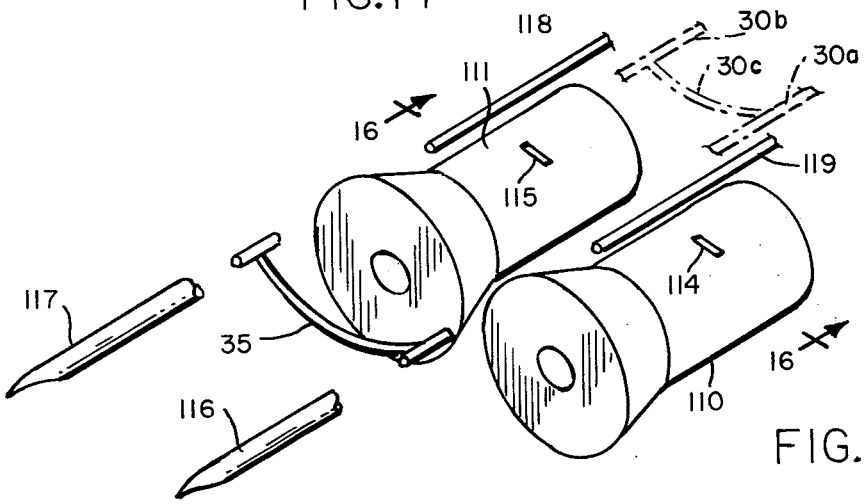
FIG. 15 illustrates in a perspective view the use of two screws for advancing wide stock as well as illustrating severing means.
Figure 16:
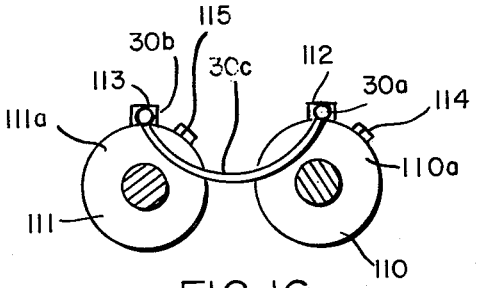
FIG. 16 diagrammatically illustrates in a sectional view taken along line 16—16 in FIG. 15, screws and severing means for dividing stock into a fastener attachment device.

In FIGS. 15 and 16 there is shown a twin feed screw arrangement whereby two feed screws 110 and 111 are used to feed stock having extra long cross links 30*c*. In this case the loops formed by the cross links would extend between the two feed screws and be positioned between threads 110*a* and 111*a* as shown in FIG. 16 while the side members 30*a* and 30*b* thereof are held in place within guides or channels 112 and 113 shown in FIG. 16. Severing means such as knives 114 and 115 are supported by the feed screws 110 and 111 to sever or divide the side members 30*a* and 30*b* of the stock to form fastener attachment devices 35.

The fastener attachment devices are fed into the hollow slotted needles 116 and 117 via the guide channels 112 and 113 and the feed screws 110 and 111, and are dispensed by plungers 118 and 119.

The screws and plungers may be hand driven as previously disclosed or powered as disclosed in FIGS. 9–13.

From the above it should now be apparent that a new and improved dispensing apparatus has been provided as well as a new and improved method for advancing fastener attachment stock and fastener attachment devices.

It should also be apparent that a new and improved method of dividing stock into fastener attachment devices has also been disclosed.

In light of this disclosure other embodiments or modifications will be understood to be encompassed by the various aspects of the invention.

I claim:

1. In a machine for dispensing fasteners severed from fastener attachment stock having a pair of side members and a plurality of cross members coupling together said side members, each of said fasteners comprising portions of said side members which form end members thereof and one of said cross members, said machine having guide means to guide and position said stock in the machine for severing and to position the fasteners after severing for dispensing and means for severing the side members of the stock to form said fasteners, said guide means including two guide channels, one channel for each of said side members and end members, said guide channels spaced apart a distance to cause said cross members to loop and the improvement comprising said guide channels continuous and shaped to guide said stock and fasteners in a first direction and then guide said fasteners in a second direction for dispensing and rotating means for advancing the stock and severed fasteners along the guide channel in both said first and second directions.

2. In a machine for dispensing fasteners severed from fastener attachment stock having a pair of side members and a plurality of cross members coupling the side members together, guide means for guiding the stock to a sever position and thereafter guiding fasteners severed from the stock to a position for being dispensed, means for severing the side members of the stock to form the fasteners comprising a cross member and portions of both of said side members which form end members thereof and means for advancing the stock and severed fasteners along said guide means, the improvement comprises said means for advancing the stock and fasteners comprising screw means for engaging cross members positioned between the threads thereof to advance said stock and said fasteners.

3. In a machine according to claim 2 in which the guide means causes said stock cross members to loop between said threads.

4. In a machine according to claim 2 in which the screw is shaped to elevate the fasteners into position for dispensing.

5. In the machine according to claim 1, the improvement of said rotating means for advancing the stock comprises screw means having threads for engaging the looped portions of said cross members to advance the stock and fasteners along said guide channels.

6. In a machine according to claim 5 in which the screw is shaped to elevate the fasteners for dispensing and move them in said second direction.

7. In a machine according to claim 5 in which the screw is shaped to increase the distance of separation between fasteners for dispensing relative to their distance of separation prior to dispensing.

8. In the machine according to claim 5 the improvement of a knife supported by said screw and projecting above some of said threads.

9. A device according to claim 8 in which selected threads are of different diameters.

10. A device according to claim 9 in which selected threads are of different pitches.

11. In a machine according to claim 8 in which said guide channels have cutouts for passage of said knife to effect severing of said side members.

12. In a machine according to claim 5 in which means is provided for rotating said screw means.

13. In a machine according to claim 8 in which means is provided for rotating said screw means.

14. In the machine for dispensing fasteners according to claim 1, the improvement comprising said guide channels being adjustable relative to one another to control the distance of separation of the side and end members during the advance thereof.

15. In the machine according to claim 2, the improvement of knife means for severing said side members between adjacent cross links while said side members are in said guide channels to form fastener attachment devices.

16. In a machine according to claim 15 in which means is provided for rotating said knife to sever said side members.

17. In a machine according to claim 15 in which the knife means comprises one knife for sequentially cutting said side members.

18. In a machine according to claim 15 in which said knife means comprises two knives, each knife movable to sever a different one of said side members.

19. In a machine according to claim 15 in which means is provided to rotate each of said knives to sever said side members.

20. In a machine according to claim 15 including guide means for confining said side members.

21. In a machine according to claim 20 in which said guide means has cutout means to permit the passage of the knife to effect severing of said side members.

22. In a machine for dispensing fasteners comprising a housing, a screw supported by the housing for rotation, a pair of guide channels adjacent the screw, said guide channels following the contour of the screw and said screw having a first diameter and a tapered increasing diameter, said screw supporting a knife for rotation, said channels having cutouts for passage of said knife upon rotation of said screw and said screw having threads of two different pitches and at different spacings, said machine accepting fastener attachment stock comprising two side members coupled together by a plurality of cross members, said guide channels causing said cross members to loop so as to be driveable by said screw threads as it rotates and said knife severing the side members to form fasteners, said screw and said guide channels cooperating to space the fasteners apart after severing and thereafter raise them for dispensing.

* * * * *